US010378191B2

(12) United States Patent
Feig

(10) Patent No.: US 10,378,191 B2
(45) Date of Patent: Aug. 13, 2019

(54) SUSPENDED CONTROLLED-RELEASE SOAP DISPENSER

(71) Applicant: Soapmobile LLC, Brooklyn, NY (US)

(72) Inventor: Steven Feig, Dix Hills, NY (US)

(73) Assignee: Soapmobile LLC, Brooklyn, NY (US)

( * ) Notice: Subject to any disclaimer, the term of this patent is extended or adjusted under 35 U.S.C. 154(b) by 292 days.

(21) Appl. No.: 15/483,658

(22) Filed: Apr. 10, 2017

(65) Prior Publication Data

US 2018/0291599 A1 Oct. 11, 2018

(51) Int. Cl.

| | |
|---|---|
| ***E03C 1/046*** | (2006.01) |
| ***A47L 17/00*** | (2006.01) |
| ***B01F 3/08*** | (2006.01) |

(52) U.S. Cl.

CPC ..... *E03C 1/0465* (2013.01); *A47L 17/00* (2013.01); *B01F 3/0865* (2013.01)

(58) Field of Classification Search

CPC ..... E03C 1/0465; B01F 3/0865; A47L 17/00
See application file for complete search history.

(56) References Cited

U.S. PATENT DOCUMENTS

| | | | | |
|---|---|---|---|---|
| 1,273,259 | A * | 7/1918 | Merrill | B01F 1/0027 422/266 |
| 2,776,787 | A | 1/1957 | Nicol | |
| 4,703,872 | A | 11/1987 | Cornette et al. | |
| 4,893,726 | A | 1/1990 | Vesborg | |
| 5,332,014 | A | 7/1994 | Feig | |
| 2004/0016826 | A1 * | 1/2004 | Rice | A47K 5/08 239/310 |

* cited by examiner

*Primary Examiner* — Jason K Niesz
(74) *Attorney, Agent, or Firm* — Hoffmann and Baron, LLP

(57) ABSTRACT

A device and method that delivers a soapy water liquid concentrate solution to a sink as the sink is filled by a stream of water from a spout. The device includes a container having a sidewall and a top wall forming an interior. The top wall includes an inlet aperture therein. The container includes at least one outlet opening. The container has within the interior a predetermined quantity of water soluble, detergent. A handle is secured to the container forming a loop above the top wall. An attachment assembly is operably securable to the spout. The attachment assembly has a first stop for retaining the handle and suspending the container therefrom. The first stop positions the container in a dispensing position wherein the inlet aperture is disposed below the spout and in the stream of water. The attachment assembly has a second stop for retaining the container in a non-dispensing position wherein the inlet aperture is not within the stream of water.

20 Claims, 10 Drawing Sheets

SUSPENDED CONTROLLED-RELEASE SOAP DISPENSER

TECHNICAL FIELD

The present disclosure relates to an apparatus and method for controllably releasing an appropriate amount of soapy water concentrate into a dishwashing sink as the sink is filled with water. More particularly, the apparatus provides a simple, economical and virtually waste-free method of introducing detergent into a dishwashing sink for dishwashing applications, most typically the cleansing of pots and pans.

BACKGROUND

The general principle of introducing soaps and detergents in controlled amounts into wash water is known. Typically, known techniques for introducing controlled amounts of soap into wash water require the use of judgment on the part of the person filling the sink, a generally unsatisfactory standard since this can lead to insufficient amounts of soap being added to the water to perform the task successfully or, alternatively, to an oversupply of the wash water with soap, thereby leading to waste. Common devices such as pump-type applicators, squeeze bottles, and measuring cups, in addition to being quite messy, also rely on the judgment of the user for dosage control and are likewise unsatisfactory.

U.S. Pat. No. 4,703,872 to Corneae, et al. and U.S. Pat. No. 4,893,726 to Vesborg disclose devices for dispensing detergent compounds into the wash water of a clothes washing machine. Such devices rely on total and continued immersion in the washing machine during agitation for the release of clothes washing detergent, typically in liquid form. Such devices possess the disadvantage of requiring opening and refilling with soap after each use, and are not suitable for institutional dishwashing since in dishwashing sinks the level of agitation is minimal as compared to a clothes washing machine.

Also known is a detergent container as described in U.S. Pat. No. 5,086,952 to Kryk. The Kryk apparatus comprises an inverted container which may be filled with detergent pellets, briquettes or the like. The container is placed outside of the sink to be filled with soap. When it is desired to fill a sink or other basin with soap, a water spray is introduced through a mesh grid in the bottom of the container, which spray dissolves the soap pellets in the container, causing soapy liquid to fall from the container into the sink being filled. This device requires a special external sink mounting and water feed, all of which greatly complicates its use, and also requires some degree of user judgment in determining the duration of water spray which is allowed to impinge upon the soap pellets while filling the sink.

U.S. Pat. No. 5,332,014 to Feig, discloses a controlled release dispenser which is placed on the bottom of a sink. Water is permitted to flow from a faucet spout into the dispenser, and soapy water flows out of it at a controlled rate. However, the dispenser must be placed on the bottom of the sink, which is problematic if there are dishes already in the sink.

Other devices include dispensers which are mounted external from, and proximate to, a sink. These dispensers need to be installed and connected to a water line. Therefore, there is a significant cost for installing and maintaining such dispensers.

It would therefore be highly desirable to provide a simple-to-use device and method for filling a sink with a required amount of soap.

SUMMARY AND OBJECTS OF THE INVENTION

The present disclosure is directed to a device and method for filling a sink or other basin with soapy water concentrate in a controlled, economical and tidy fashion.

The present disclosure is further directed to a device for the delivery of a soapy water liquid concentrate solution to a sink as the sink is filled by a stream of water from a spout. The device includes a container having a sidewall and a top wall forming an interior. The top wall includes an inlet aperture therein. The container includes at least one outlet opening. The container has, within the interior, a predetermined quantity of water soluble, detergent. A handle is secured to the container forming a loop above the top wall. An attachment assembly is operably securable to the spout. The attachment assembly has a first stop for retaining the handle and suspending the container therefrom. The first stop positions the container in a dispensing position wherein the inlet aperture is disposed below the spout and in the fill water stream water. The attachment assembly has a second stop for retaining the container in a non-dispensing position wherein the inlet aperture is not within the stream of water.

The present disclosure is still further directed to a method for the controlled delivery of a soapy water liquid concentrate solution to a sink as the sink is filled by a stream of water from a source of fill water, the method comprising the steps of:

suspending a container from a spout adapted to emit the stream of water, the container having a sidewall and a top wall forming an interior, the top wall including an inlet aperture therein, the container including at least one outlet opening, the container having within the interior a predetermined quantity of water soluble detergent, a handle secured to the container forming a loop above the top wall;

securing a first stop to the spout, the first stop receiving the handle and positioning the first stop wherein the inlet aperture is disposed below a spout in the stream of water to create a soapy solution in the sink; and securing a second stop to the spout, the second stop receiving the handle and positioning the container in a non-dispensing position wherein the inlet aperture is not within the stream of water to stop the production of soapy solution.

DETAILED DESCRIPTION OF THE DRAWINGS

In the drawings, wherein like reference characters denote similar elements throughout the several views.

Figure 5:
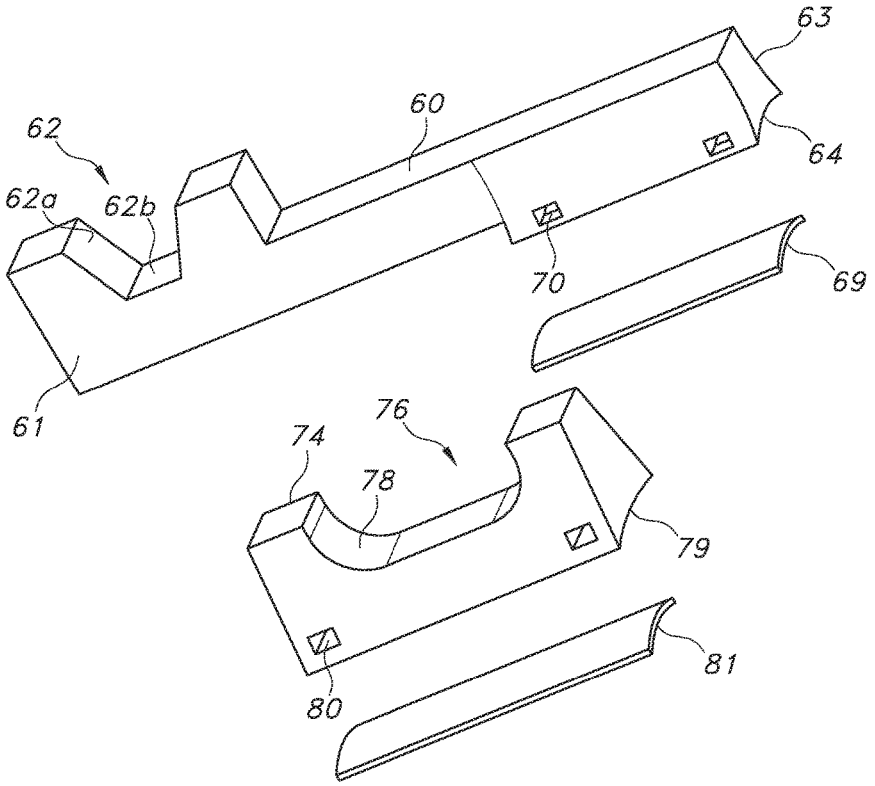
Figure 6:
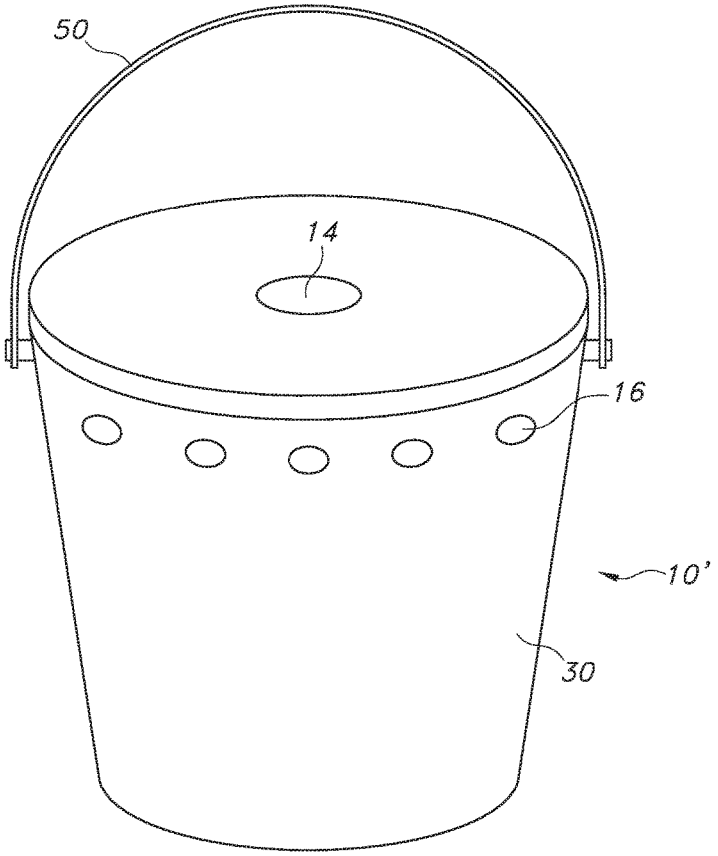
Figure 7:
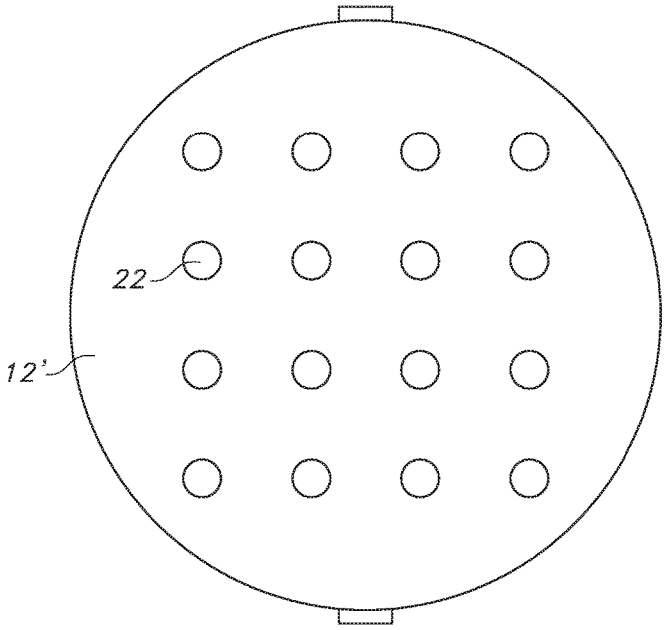
Figure 8:
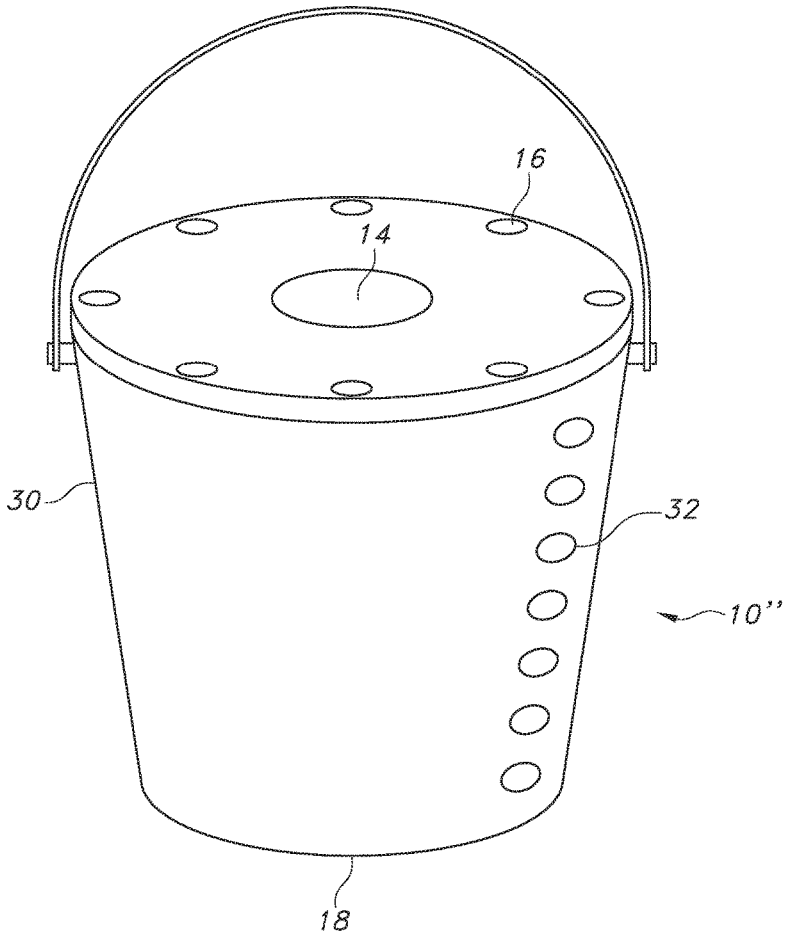
Figure 9:
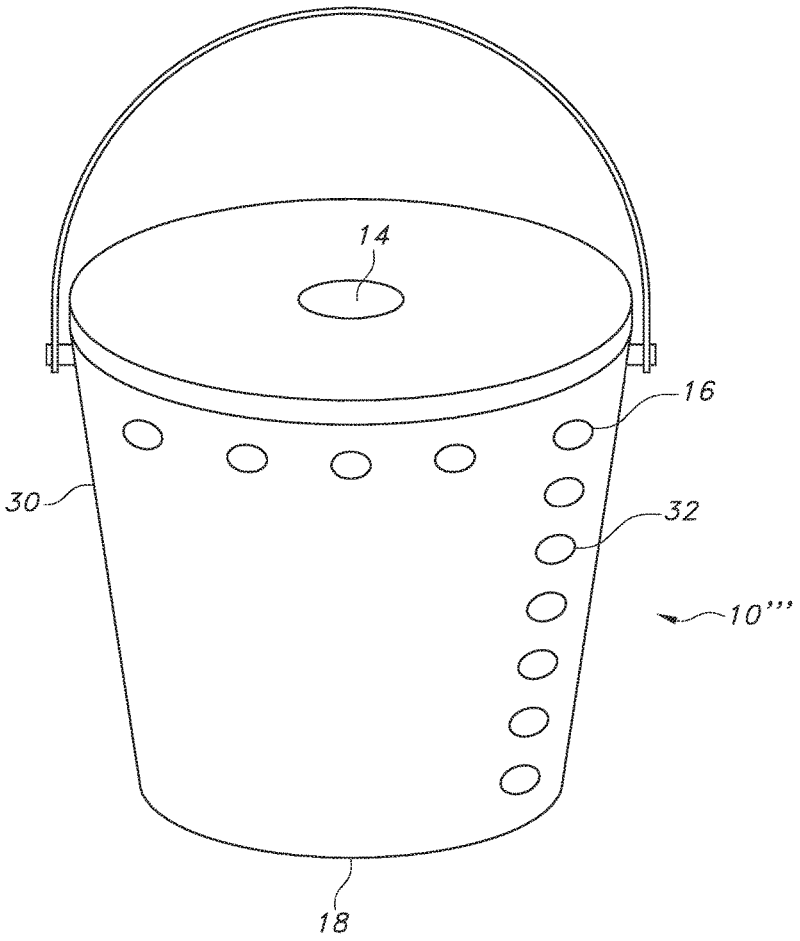

FIG. 5 a perspective view of a dispenser attachment assembly;

FIG. 6 depicts an alternate embodiment of a soap dispenser wherein the outlet apertures are positioned circumferentially about the container sidewall top or upper surface;

FIG. 7 is a top plan view of an alternative embodiment of the soap dispensing device;

FIG. 8 is an elevated side perspective view of an alternate embodiment of a soap dispenser wherein a series of weep holes are disposed vertically along the sidewall of the container;

FIG. 9 depicts another alternate embodiment including both the weep holes of FIG. 8 and the outlet apertures of FIG. 6 on the sidewall of the container.

DETAILED DESCRIPTION OF THE PREFERRED EMBODIMENTS

The present disclosure relates to a controlled release soap dispenser which may be simply used to dose a sink with a suitable amount of soapy water concentrate. The device is configured as an essentially sealed container which contains a soap or detergent concentrate. The detergent may be in the form of a semi-sold concentrate. The device is placed in a sink suspended between the spout and the sink bottom, and a source of fill water is directed into the container through an inlet aperture at the top of the container. This inlet water, entering the container under pressure, creates currents within the container, agitating the water in the container against the soap concentrate and causing it to dissolve, thereby creating a soapy water concentrate solution. This solution is ejected from the container by the entry of fill water into the container through the inlet aperture. The formation of soapy water concentrate is a function of the pressure of the water entering through the container, which pressure determines the degree of agitation of the water in the container, and the temperature of the agitated water, both factors influencing the degree to which the semi-solid soap concentrate dissolves to form the soapy water concentrate solution.

When the sink is sufficiently filled with soapy water, the dispenser may be moved to a non-dispensing position out of the flow of the water. In this way, the sink can be filled to the desired level with soapy water. The device is disposable and when the soap concentrate is used up, the device may be discarded and replaced with a fresh one.

Figure 1:
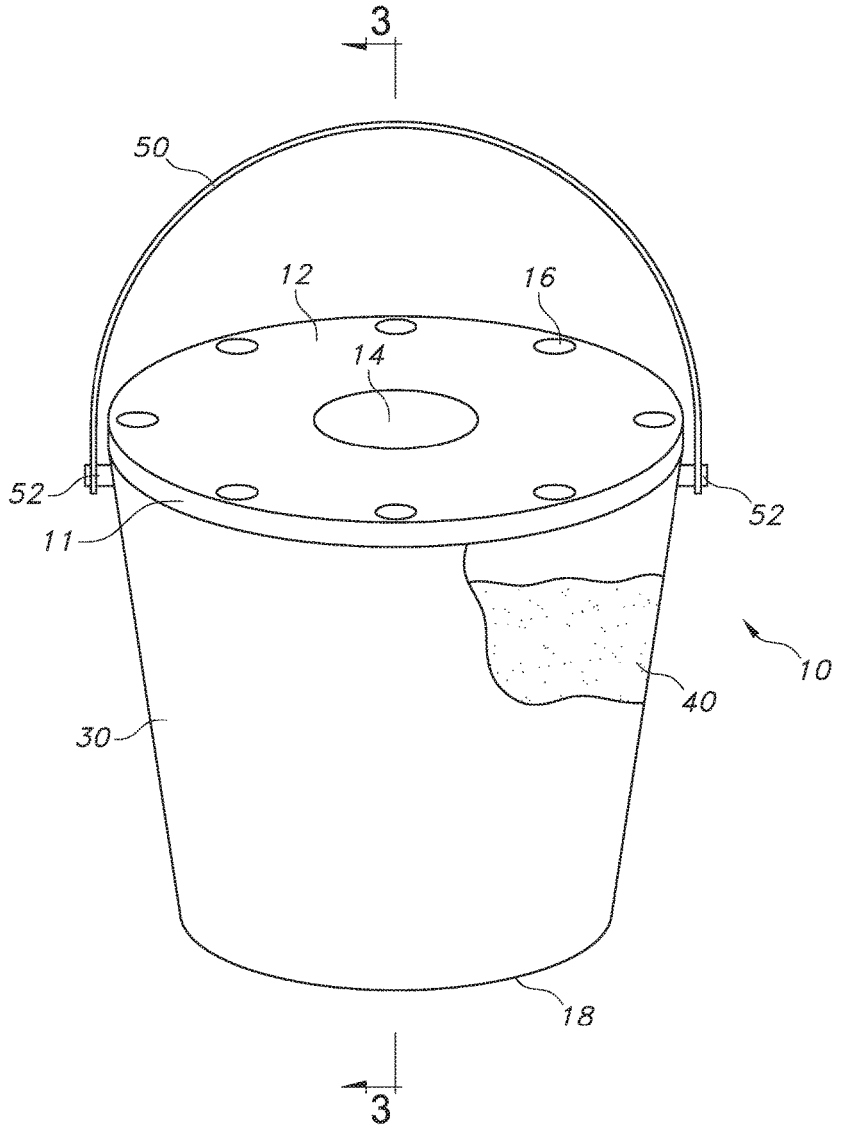
FIG. 1 is a side perspective view of a soap dispensing device of the present disclosure.
Figure 3:
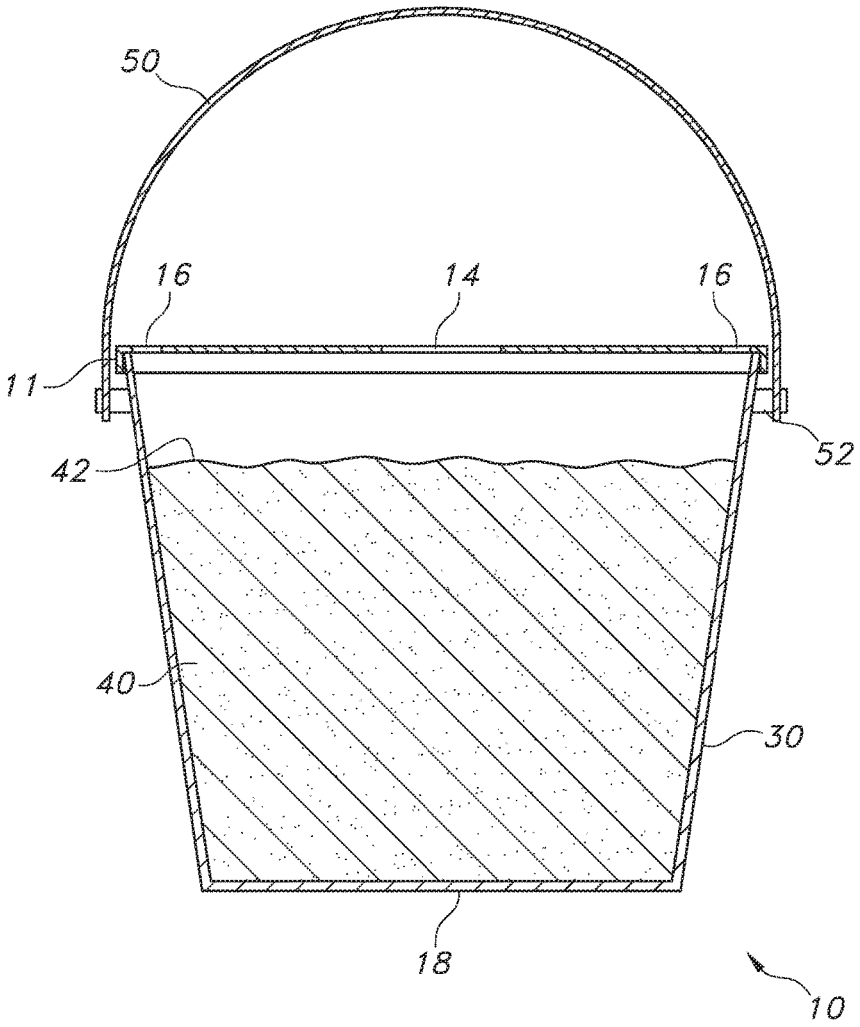
FIG. 3 is a sectional view taken along the lines 3-3 in FIG. 1 and showing the detergent concentrate disposed within the dispenser.
Figure 4:
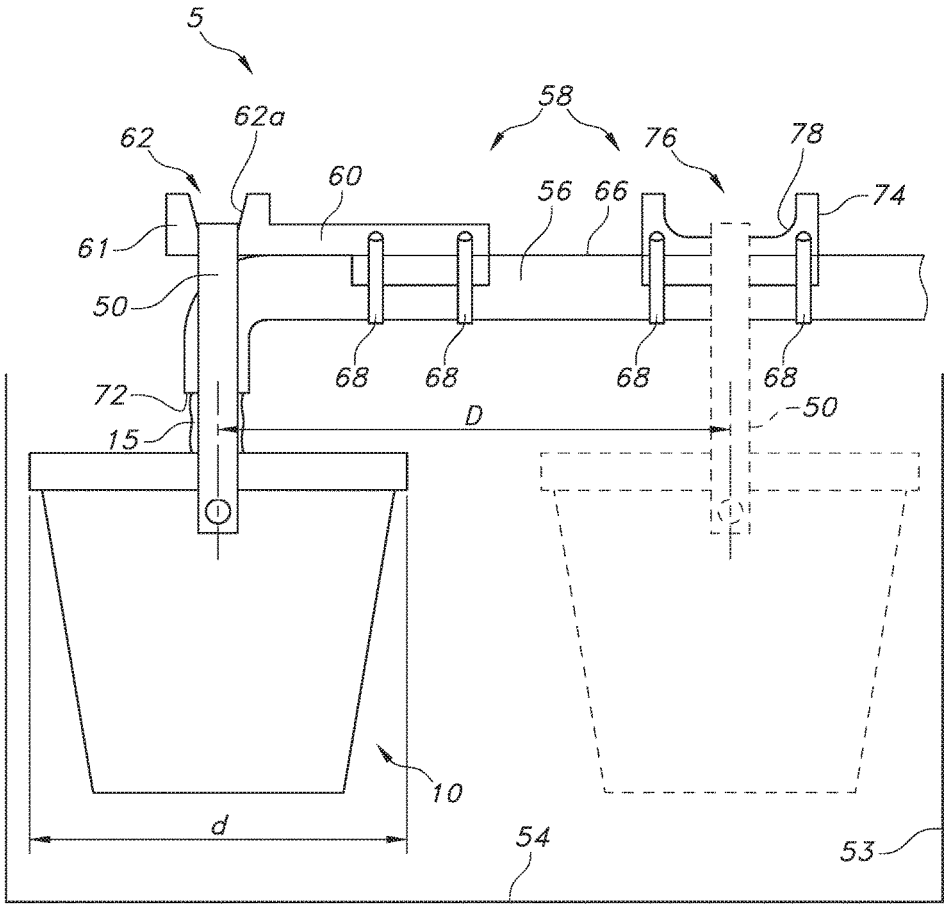
FIG. 4 is side elevational view showing the dispenser secured to a spout of a sink showing the dispenser in a dispensing position and a non-dispensing position in phantom.

With initial reference to FIGS. 1, 3 and 4, there is shown a preferred embodiment of a controlled-release soap dispenser 5 including a substantially closed, cylindrical container 10 having an upper or top surface 12, a continuous sidewall 30 and an essentially flat bottom or base 18. An arcuate-shaped handle 50 is attached to the sidewall 30 forming a loop. The handle 50 is preferably pivotally secured to the upper portion of the sidewall at attachment points 52 diametrically opposed to each other. In this way the handle 50 will loop over the center of the top surface 12.

In a preferred embodiment, the container 10 is generally cylindrical, although it will be recognized that the container may have different shapes and may be rounded, squared, tapered, or assume any other shape as long as the container is configured to permit the container 10 to be suspended in a sink 53 above a sink bottom 54 and below the spout 56 of a sink's faucet as shown in FIG. 4.

The container 10 has a lid 11 including a top or upper surface 12 through which an inlet aperture 14 is formed therethrough. The inlet aperture 14 is predeterminately sized to permit a flow of fill water 15 from a sink spout 56 to be directed therethrough to reach the interior of the container 10. In one embodiment, the inlet aperture 14 has a diameter of approximately ⅞", although it will be readily recognized by those skilled in the art that the size of the inlet aperture may be suitably varied to accommodate streams of water of varying diameters.

Figure 2A:
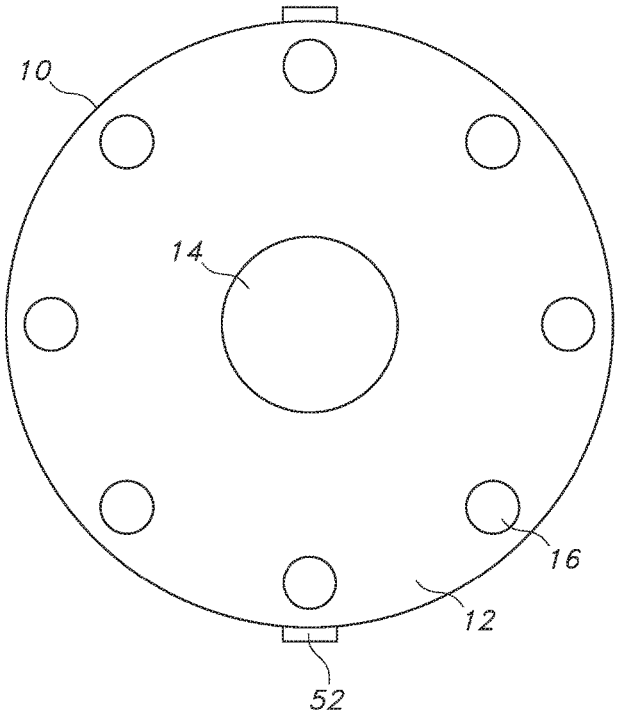
FIG. 2A is a top plan view of the soap dispensing device of FIG. 1 with a handle removed.
Figure 2B:
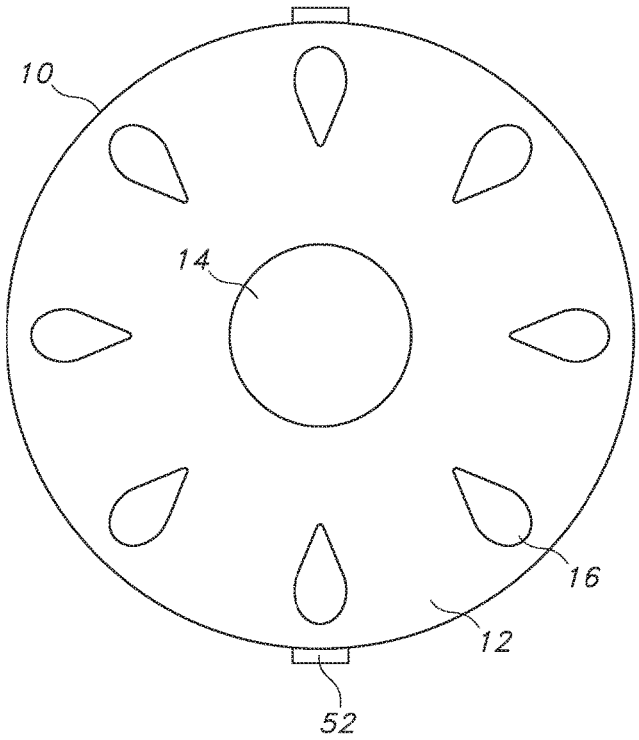
FIG. 2B is a top plan view of the soap dispensing device of FIG. 1 with a handle removed and showing an alternative embodiment of outlet apertures.

Also positioned on the upper surface 12 of container 10, as shown in FIGS. 2A and 2B, are a plurality of outlet apertures 16. The outlet apertures 16 are preferably positioned in a circumferentially circular pattern, the circular pattern being generally concentric with the peripheral edge of the inlet aperture 14. In one exemplary embodiment, as seen in FIG. 2A, there is a single inlet aperture 14 and eight outlet apertures 16, positioned in a circular pattern around the inlet aperture on the upper surface 12 of the container 10. The outlet apertures may be round, FIG. 2A or formed in other shapes such as oval or teardrop-shaped, FIG. 2B for example. The top surface 12 may be covered with a removable layer to cover the top surface 12 and any apertures therein. Prior to use, the layer may be removed in order to expose the apertures.

Referring now to FIG. 4, there is seen a sectional view of the container 10 showing the interior of the container 10 filled with a semi-solid soap concentrate 40. This malleable soap concentrate, also known in the art as semi-solid detergent, or high-density semi-solid detergent, substantially fills the container 10 and, as a resultant property of the semi-solid detergent, remains substantially affixed to the interior of container 10 by natural adhesion. The soap concentrate is sealed within the substantially closed container 10. The semi-solid soap concentrate 40 is of a type particularly well suited for use in institutional dishwashing applications, especially pot and pan washing applications. One type of semi-solid soap concentrate particularly suited for use in the present invention is marketed under the trade name SOLID GOLD, manufactured and sold by CLEANSE TEC of Brooklyn, N.Y. However, it will be recognized by those skilled in the art that other formulations of semi-solid soap concentrate, freely available in the marketplace, may also be utilized within the container 10 providing they have the required dissolution and detergent concentration characteristics required for institutional pot and pan washing applications in accordance with the present disclosure. It is further contemplated that the soap concentrate could be in the form of a liquid, gel or solid.

With reference to FIGS. 4 and 5, the container 10 is suspended from a faucet spout 56 by an attachment assembly 58. The assembly 58 includes a dispensing support 60. The dispensing support may be an elongate member having a distal upper end 61 including first stop which retains the container 10 in a predetermined dispensing position such that the inlet aperture 14 is positioned directly in the stream of the fill water 15. The first stop may be in the form of a first notch 62 sized to accommodate the container handle 50 therein. The first notch 62 may have taper sidewalls 62*a* which narrow as they extend to a flat base 62*b* forming a generally V-shaped notch. A proximal lower end 63 of the dispensing support may have a concave surface 64 for sitting on a spout curved upper surface 66. The dispensing support 60 may be secured to the spout by a clamping device 68 such as a cable tie or other type of clamping device. The dispensing support 60 may have a pair of spaced slots 70 through which the cable ties 68 may be extended to secure the dispensing support 60 to the spout. A piece of resilient material 69 may be placed between the concave surface 64 and the spout upper surface 66 in order to assist in retaining the dispensing support 60 in position.

The dispensing support 60 may be positioned on the spout 56 such that the first notch 62 is above the spout opening 72 from which the water flows such that the stream of water flows into the inlet aperture 14. When the handle 50 is placed over the spout and into the first notch 62, the spout opening preferably sits above the inlet aperture 14 located at the center of the top surface. If the spout opening 72 is angled such that the water stream is not directed directly down toward the sink bottom, the dispensing support 60 can be positioned on the spout such that the water stream enters the inlet aperture 14 when the container is retained at the first notch 62.

The attachment assembly 58 further includes a non-dispensing support 74 having an upper surface including a second stop for retaining the container 10 at a predetermined non-dispensing position. The second stop may include a second notch 76 formed in the non-dispensing support 74. The second notch walls 78 may be curved to permit the handle 50 to be easily slid in the second notch 76. The non-dispensing support 74 may have a concave bottom surface 79 to correspond to the spout upper surface 66. The non-dispensing support 74 may have a pair of spaced slots 80 through which clamping devices 68 such as cable ties may be extended to secure the non-dispensing support to the spout. A piece of resilient material 81 may be placed between the concave bottom surface 79 and the spout upper surface 66 in order to assist in retaining the non-dispensing support 74 in position.

The second notch 76 of the non-dispensing support 74 is preferably placed offset a distance D from the spout opening 72 such that when the container handle 50 is placed in the second notch, the container 10 is out of the flow of water from the spout. Accordingly, the offset distanced D may be a function of the diameter, d, of the container 10.

In one embodiment, the dispensing support 60 and the non-dispensing support 74 are formed of two separate pieces. This permits the distance between the first and second notches to be adjusted. However, it is within the contemplation of the present invention that the two supports could be formed on one integrally formed piece.

With further reference to FIG. 4, in use, the container 10 is placed in the dispensing position by placing the container handle 50 in the first notch 62 below the faucet spout 56 of the sink or basin to be filled. The container 10 is suspended above the sink bottom 54; therefore, pots and dishes may be left in the sink to be cleaned. The container 10 is, more particularly, positioned within the sink beneath the spout opening 72 or the like from which the stream of fill water 15 emanates, and so that the stream is directed toward and into the inlet aperture 14. The faucet, hose, valve or spigot which provides fill water to the sink is turned on, set to a desired temperature, and the stream of water 15 is thereby directed into and through the inlet aperture 14. The water entering inlet aperture 14 under pressure forms currents within the container 10, which causes the water in the container to agitate along the upper soap surface 42 of the semi-solid soap concentrate 40, commingling and interacting therewith to dissolve a fractional part thereof and form a soapy water concentrate solution. This soapy water concentrate solution is forced out of the container 10 through the outlet apertures 16 by the increased pressure generated in the container 10 as new fill water from the faucet feeding the sink enters through the inlet aperture 14.

Referring again to FIGS. 2A and 2B, the plurality of outlet apertures 16 positioned circumferentially about the inlet aperture 14 effectively divide the pressure of the incoming water evenly for controlled distributive dispersal of soapy water concentrate out of the container through outlet apertures 16 with a minimum of splashing. The flow of water from the spout to inlet aperture 14 is allowed to continue, during which time soapy water concentrate, ejected through outlet apertures 16, gradually fills the sink. When the level of soapy water concentrate in the sink rises to a desired level, the container 10 may optionally be moved to the second notch 76, such that the container is no longer in the water stream. The sink may include a level mark on its sidewall to permit a user to know what amount of soapy water is optimal. With the container in the non-dispensing position, the sink is allowed to continue to fill normally with plain water from the faucet's spout 56. The continued filling of the sink with plain water, after such repositioning of the container 10, affects a reduction in the concentration of detergent in the soapy water mixture to a usable working amount or concentration, after which pot, pan or dishwashing may commence in the sink.

Upon optional removal of the container 10 from the first notch 62 or second notch 76, the container 10 may be inverted by a user to drain any excess water from the container. The container 10 may then be placed in the non-dispensing position in the second notch 76 until a fresh supply of soapy water is required. At which time the above-described process is repeated. When all of the semi-sold soap concentrate 40 in the container 10 is used up, the entire container 10 may be discarded.

Accordingly, the container 10 can provide soapy water for cleaning purposes without the need to install the container or connect it to a water supply. After all the soap is used up in one container, a user simply selects a new, fresh container 10 and suspends it from the spout 56 in the manner set forth above.

It will be recognized by those skilled in the art that the above-described formation of soapy water concentrate is in significant part a result of the commingling and interaction between the semi-solid soap concentrate 40 and the currents of water created in the container by the water stream entering the container 10 under pressure through the inlet aperture 14. The formation of soapy water concentrate resultant from this combination is at a maximum when the water entering the inlet aperture 14 is directed thereto from a faucet spout, spigot, hose or other pressurized water source. If the container 10 is suspended into the sink interior below the sink top, the water could be permitted to flow above the top surface 12 of the container. As the water level rises above the top surface 12, water entering the sink 53 from the spout or other water source will no longer enter inlet aperture 14 under pressure, and therefore only negligible soapy water concentrate formation will take place after the sink fills to a level above the upper surface 12. For that reason, the process of releasing a controlled dose of soapy water concentrate into the sink 53 by the above-described method is self-terminating, since once the water level rises above the upper level of upper surface 12, soapy water concentrate formation essentially ceases in this way. The introduction of soapy water concentrate is highly controlled, greatly reducing the opportunity for waste by the user or for overdosing the wash water with too high a concentration of detergent.

In a currently preferred embodiment, the container 10 is a cylinder having a height of approximately 4⅞" and circular base having a diameter of approximately 4¾". Inlet aperture 14 is predeterminately circularly shaped with a diameter of approximately ⅞", and outlet apertures 16 are predeterminately configured as circular bores each having a diameter of approximately ¼". The container may, for example, be filled with approximately 2 lbs. of semi-solid soap concentrate of a type previously described above and, when used in institutional sinks having capacities in the 10 to 20 gallon range (most typically 15 gallons) a device so configured will provide approximately 15 sinks full of adequately-dosed soapy water for use in institutional pot, pan and dishwashing applications. These dimensions and weights are exemplary, and it is within the contemplation of the present disclosure that the dimensions and amount of soap could be varied.

Referring to FIG. 6, there is shown an alternate embodiment of the controlled release soap dispenser 10'. In this alternate embodiment, the outlet apertures 16 are formed in the sidewall 30 as opposed to the upper surface 12 and, more particularly, in the upper portion of sidewall 30 closely proximate the upper surface 12. The outlet apertures 16 are uniformly spaced about the container 10 along sidewall 30 and, in similar fashion to the embodiment of FIG. 1, provide multiple outlet paths for the water entering through the inlet aperture 14 so as to reduce splashing and spraying of the soapy water concentrate exiting the container 10 through the outlet apertures. The method of use of the container 10 as configured in the alternate manner of FIG. 6 is the same as that described above for the embodiment shown in FIG. 1.

In another alternate, depicted in FIG. 7, the upper surface 12' is configured to contain a plurality of combined inlet/outlet apertures 22. In use, the container 10 of FIG. 7 is placed suspended in the sink as described above, and the upper surface 12' is located and oriented so that a portion of its surface containing apertures 22 lies beneath the flow of water from the faucet or other incoming source. Water then enters through those apertures 22 which lie beneath the water stream, and the remaining apertures 22 form the outlet apertures for the soapy water concentrate. In this FIG. 7 embodiment, the exact placement of the device beneath the water source is less critical since there is no single inlet aperture through which the water source must be directed.

With reference now to FIGS. 8 and 9, there are shown two additional alternate embodiments 10" and 10'", similar to those depicted in FIGS. 1 and 6, respectively, but including the additional feature of a series of weep holes 32 arranged vertically along the sidewall 30. The weep holes 32 are configured in a substantially linear pattern and extend in a longitudinal direction from upper surface 12 to the base 18 along the sidewall 30. The weep holes 32 are specifically provided so that upon removal of the container 10 from the dispensing position after filling of the sink with soapy water, water remaining within the container 10 will automatically drain through the weep holes 32 without inversion of the container, thereby preventing water retention within the container and undesired dissolving of the semi-solid soap concentrate 40 during periods of nonuse.

In addition, the concentration of soapy water ultimately yielded may be varied by the user by varying the water pressure and/or the temperature of the water to suit individual application needs. Typical water temperatures for institutional pot and pan washing application averages in a range between approximately 100° to 140° F., while typical water pressures encountered in institutional dishwashing sink runs from approximately 12 to 30 pounds. The end user, by selectively varying the water pressure and temperature, may accordingly vary the quantity of soapy water concentrate formed in the container and entering the sink, thereby varying the ultimate detergent level in the sink as required to suit that user's particular requirements.

Given the teachings provided herein, one of ordinary skill in the art will be able to contemplate other implementations and applications of the techniques of the disclosed embodiments. Although illustrative embodiments have been described herein with reference to the accompanying drawings, it is to be understood that these embodiments are not limited to the disclosed embodiments, and that various other changes and modifications are made therein by one skilled in the art without departing from the scope of the appended claims.

What is claimed is:

1. A device for the delivery of a soapy water liquid concentrate solution to a sink as the sink is filled by a stream of water from a faucet spout, the device comprising:

a container having a sidewall and a top wall forming an interior, the top wall including an inlet aperture therein, the container including at least one outlet opening;

the container having within the interior a predetermined quantity of water soluble detergent;

a handle secured to the container forming a loop above the top wall; and an attachment assembly operably securable to the spout, the attachment assembly, having a first stop for retaining the handle and suspending the container therefrom, the first stop positioning the container in a dispensing position wherein the inlet aperture is disposed below the spout and in the fill water stream of, the attachment assembly having a second stop for retaining the container in a non-dispensing position wherein the inlet aperture is not within the stream of water.

2. The device according to claim 1, wherein inlet aperture is predeterminately-sized and oriented such that when the container is in the dispensing position, the stream of water from the source of fill water enters the container through the inlet aperture and agitates against, and commingles with, the detergent in the container so as to dissolve a predetermined fractional quantity of the detergent in the fill water entering the container and thereby form a soapy water liquid concentrate.

3. The device according to claim 2, wherein the container includes a plurality of outlet openings from which the soapy water concentrate is ejected from the container by the stream of fill water into the inlet aperture.

4. The device according to claim 3, wherein the inlet aperture is disposed proximate to the plurality of outlet openings on the upper surface.

5. The device according to claim 1, further comprising a weep hole defined through a surface of the container, the weep hole being disposed such that upon removal of the container from the sink, water remaining in the container is permitted to drain from the container through the weep hole while the container is non-inverted.

6. The device according to claim 3, wherein the water soluble detergent includes a semi-solid detergent.

7. The device according to claim 3, wherein the container is dimensioned as a cylinder, the cylinder having at one end, plane the base, and at an opposite end plane, the upper surface, and having as a cylinder body a continuous sidewall.

8. The device according to claim 1, wherein the inlet aperture opening is disposed at the approximate center of the upper surface, and the plurality of outlet openings are teardrop-shaped openings disposed circumferentially around and concentric to the inlet aperture.

9. The device according to claim 1, wherein the first stop includes a first notch for receiving the handle therein and maintaining the container in the dispensing position.

10. The device according to claim 9, wherein the second stop includes a second notch for receiving the handle therein and maintaining the container in the non-dispensing position.

11. The device according to claim 1, wherein the second stop is offset a distance from the first stop an amount responsive to a diameter of the container.

12. The device according to claim 1, wherein the first stop and second stop are formed on separately formed pieces.

13. The device according to claim 1, wherein the first stop is positioned on the spout wherein the inlet aperture is disposed directly in the water stream.

14. The device according to claim 1, wherein the attachment assembly includes a dispensing support including the first stop and non-dispensing support including the second stop, the dispensing support and non-dispensing support each having a concave lower surface adapted to conform with the spout.

15. A method for the controlled delivery of a soapy water liquid concentrate solution to a sink as the sink is filled by a stream of water from a source of fill water, the method comprising the steps of:

suspending a container from a spout adapted to emit the stream of water; the container having a sidewall and a top wall forming an interior, the top wall including an inlet aperture therein, the container including at least one outlet opening, the container having within the interior a predetermined quantity of water soluble, detergent, a handle secured to the container forming a loop above the top wall;

securing a first stop to the spout, the first stop receiving the handle and positioning the first stop wherein the inlet aperture is disposed below a spout in the stream of water to create a soapy solution in the sink; and securing a second stop to the spout, the second stop receiving the handle and positioning the container in a non-dispensing position, wherein the inlet aperture is not within the stream of water to stop the production of soapy solution.

16. The method as defined in claim 15, wherein when the container is positioned at the first stop, the stream of water enters the container through the inlet aperture and agitates against and commingles with the detergent so as to dissolve a predetermined fractional quantity of the detergent in the fill water entering the container and thereby forming a soapy water liquid concentrate; and continuing to direct the stream of fill water toward and through the inlet aperture so as to cause the ejection of the soapy water concentrate from the outlet opening, and through which the soapy water concentrate is ejected from the container by increased pressure developed in the container as a result of the entry of fill water through the inlet aperture, so that the ejection gradually fills the sink with the ejected soapy water liquid concentrate.

17. The method as defined in claim 16, further comprising moving the container from the first stop to the second stop after the sink is filled with a predetermined amount of soapy water liquid concentrate.

18. The method as defined in claim 15, wherein a distance between a retained position of the first stop and a retained position of the second stop is responsive to a diameter of the container.

19. The method as defined in claim 15, wherein the first stop includes a first notch for receiving the handle.

20. The method as defined in claim 15, wherein the second stop includes a second notch for receiving the handle.

* * * * *